US008360539B2

(12) United States Patent
Brown et al.

(10) Patent No.: US 8,360,539 B2
(45) Date of Patent: Jan. 29, 2013

(54) DRAWER ASSEMBLY

(75) Inventors: Andrew D. Brown, Anderson, SC (US); Michael Bayne, Easley, SC (US)

(73) Assignee: Electrolux Home Products, Inc., Cleveland, OH (US)

( * ) Notice: Subject to any disclaimer, the term of this patent is extended or adjusted under 35 U.S.C. 154(b) by 188 days.

(21) Appl. No.: 12/714,114

(22) Filed: Feb. 26, 2010

(65) Prior Publication Data

US 2011/0210655 A1 Sep. 1, 2011

(51) Int. Cl.
*A47B 96/00* (2006.01)

(52) U.S. Cl. ..... 312/402; 312/404; 312/331

(58) Field of Classification Search ..... 312/402, 312/404, 408, 410, 331, 334.7, 334.8
See application file for complete search history.

(56) References Cited

U.S. PATENT DOCUMENTS

| | | | | |
|---|---|---|---|---|
| 2,833,325 | A * | 5/1958 | Laisy | 411/260 |
| 3,356,401 | A * | 12/1967 | Bertram | 52/506.05 |
| 3,744,270 | A | 7/1973 | Wilcox | |
| 3,771,849 | A | 11/1973 | Barber | |
| 4,324,439 | A * | 4/1982 | Hagen et al. | 384/18 |
| 4,955,676 | A * | 9/1990 | Weaver et al. | 312/407 |
| 5,409,309 | A | 4/1995 | Giddings et al. | |
| 5,425,245 | A * | 6/1995 | Martin et al. | 62/187 |
| 5,820,239 | A | 10/1998 | Christenson et al. | |
| 6,257,303 | B1 | 7/2001 | Coubray et al. | |
| 6,447,083 | B1 | 9/2002 | Chiapetta | |
| 6,565,170 | B2 | 5/2003 | Banicevic | |
| 6,609,774 | B2 | 8/2003 | Banicevic | |
| 6,641,239 | B2 | 11/2003 | Kaiser | |
| 6,893,199 | B2 * | 5/2005 | Michels | 411/340 |
| 6,988,992 | B2 * | 1/2006 | Just et al. | 600/499 |
| 7,145,308 | B1 * | 12/2006 | Chase | 318/400.41 |
| 7,159,415 | B2 | 1/2007 | Wood | |
| 7,411,499 | B2 * | 8/2008 | Nichols, Sr. | 340/572.1 |
| 7,430,937 | B2 | 10/2008 | Rotter | |

(Continued)

FOREIGN PATENT DOCUMENTS

| | | |
|---|---|---|
| JP | 53118665 | 10/1978 |
| KR | 100634361 | 9/2006 |

(Continued)

OTHER PUBLICATIONS

International Search Report for PCT/US2011/026168, dated Sep. 5, 2011, 3 pages.

*Primary Examiner* — James O Hansen
*Assistant Examiner* — Matthew Ing
(74) *Attorney, Agent, or Firm* — Pearne & Gordon LLP

(57) ABSTRACT

A drawer assembly is provided for an enclosure which includes a first interior surface and a second interior surface which are opposite one another. The drawer assembly includes a drawer, a first rack, a second rack, a first linear motion element and a second linear motion element. The drawer is configured to be insertable in the enclosure. The first rack and the second rack are mounted respectively near the first interior surface and the second interior surface. The first linear motion element and the second linear motion element are mounted respectively near the first interior surface and the second interior surface. Each of the linear motion elements is configured to enable movement of the drawer in and out of the enclosure. Each of the linear motion elements includes a pinion configured to rotate along a corresponding rack as the drawer is moved in and out of the enclosure.

9 Claims, 15 Drawing Sheets

U.S. PATENT DOCUMENTS

2002/0178600 A1* 12/2002 Machida et al. ..... 33/645
2004/0046488 A1* 3/2004 Hogan ..... 312/322
2005/0160854 A1 7/2005 Rotter
2006/0021373 A1 2/2006 Oh
2006/0087208 A1 4/2006 Oh
2007/0144408 A1 6/2007 Rotter
2007/0262686 A1 11/2007 Kook
2008/0074019 A1 3/2008 Park
2008/0314067 A1* 12/2008 Lee ..... 62/441
2009/0026906 A1 1/2009 Kim
2009/0167130 A1* 7/2009 Chellappan et al. ..... 312/402

FOREIGN PATENT DOCUMENTS

WO 2007007950 1/2007

* cited by examiner

DRAWER ASSEMBLY

TECHNICAL FIELD

The apparatus and methods described herein relate to a drawer assembly for a cabinet structure and, more particularly, a drawer assembly for avoid slanting of the drawer during horizontal movement.

BACKGROUND

Drawer assemblies of a cabinet structure often utilize laterally located sliding mechanisms to allow horizontal movement for opening and closing of the drawer. When the two slide mechanisms move horizontally at different rates, the drawer can become slanted about the direction of horizontal progress and may even become stuck in the cabinet. In order to prevent such problems to the user, various means to ensure even horizontal movement of the sides of the drawer have been devised.

SUMMARY

The following presents a simplified summary of the disclosure in order to provide a basic understanding of some example aspects described in the detailed description.

In one example aspect, a drawer assembly is provided for an enclosure including a first interior surface and a second interior surface. The interior surfaces are opposite one another. The drawer assembly includes a first rack, a second rack and a drawer. The first rack and a second rack are mounted respectively near the first interior surface and the second interior surface. Each of the racks includes first teeth provided longitudinally along thereof. The drawer is configured to be movable in and out the enclosure and includes a first face near the first interior surface and a second face near the second interior surface. The drawer includes a first pinion and a second pinion rotatably coupled near the first face and the second face respectively. The pinions include circumferential second teeth. The first pinion and the second pinion are configured to mesh with the first rack and the second rack respectively. A groove is provided to extend across one of the first teeth and the second teeth and a wall is provided to extend across the other of the first teeth and the second teeth. The wall is configured to be guided by the groove as the first and second pinions rotate along the first rack and the second rack respectively and the drawer moves in and out of the enclosure.

In another example aspect, the drawer assembly includes a first linear motion element and a second linear motion element mounted respectively between the first face and the first interior surface and between the second face and the second interior surface. Each of the linear motion elements are configured to enable movement of the drawer in and out of the enclosure.

In yet another example aspect, each of the linear motion elements includes a stationary member and a moving member. The moving member is mounted about each of the first face and the second face. The stationary member is mounted about each of the interior surfaces. The pinion is coupled to the moving member.

In yet another example aspect, the stationary member and the moving member are telescoping members.

In yet another example aspect, the linear motion element uses a slide mechanism.

In yet another example aspect, the drawer assembly includes a timing bar configured to couple the first pinion and the second pinion so that the pinions rotate as one.

In yet another example aspect, the wall and the other of the first teeth and the second teeth are substantially the same in height.

In yet another example aspect, a width of the groove substantially matches a width of the wall and a depth of the groove substantially matches a height of the wall.

In yet another example aspect, the groove extends across a center of the one of the first teeth and the second teeth and the wall extends across a center of the other of the first teeth and the second teeth.

In yet another example aspect, the groove and the wall are oriented to extend parallel to the racks and the racks extend in a direction of movement of the drawer.

In yet another example aspect, a drawer assembly is provided for an enclosure including a first interior surface and a second interior surface. The interior surfaces are opposite one another. The drawer assembly includes a first rack, a second rack and a drawer. The first rack and the second rack are mounted respectively near the first interior surface and the second interior surface. One of the racks includes a first marking indicating a predetermined location along a length of the rack. The drawer is configured to be movable in and out of the enclosure and includes a first face near the first interior surface and a second face near the second interior surface. The drawer includes a first pinion and a second pinion rotatably coupled near the first face and the second face respectively. The pinions include circumferential second teeth. The first pinion and the second pinion are configured to mesh with the first rack and the second rack respectively. One of the pinions includes a second marking indicating a predetermined angular position of the pinion such that the predetermined location and the predetermined angular position correspond to a state of assembly.

In yet another example aspect, the drawer assembly further includes a first linear motion element and a second linear motion element mounted respectively near the first interior surface and the second interior surface. Each of the linear motion elements is configured to enable movement of the drawer in and out of the enclosure.

In yet another example aspect, the first marking is shown on a side of the one of the racks and the second marking is shown on a side of the one of the pinions.

In yet another example aspect, the first marking and the second marking are shaped to indicate a state of alignment for the predetermined location and the predetermined angular position.

In yet another example aspect, the first marking and the second marking are triangular in shape.

In yet another example aspect, each of the two racks includes the first marking and each of the pinions including the second marking.

In yet another example aspect, the drawer assembly further includes a timing bar configured to couple the first and second pinions so that the pinions rotate as one.

In yet another example aspect, a method of assembling a drawer assembly is provided for an enclosure including a first interior surface and a second interior surface. The drawer assembly includes a drawer, a first rack, a second rack, a first linear motion element, a second linear motion element and a timing bar. The drawer is configured to be insertable in the enclosure. The first rack and the second rack are mounted respectively near the first interior surface and the second interior surface. The first linear motion element and the second linear motion element are mounted respectively near the first interior surface and the second interior surface. The linear motion elements are configured to enable movement of the drawer in and out of the enclosure. A pinion is coupled to each of the linear motion elements and is configured to rotate along a corresponding rack as the drawer is moved in and out of the enclosure. Each of the pinions includes a neck portion. The timing bar includes a first end and a second end. The method includes the steps of inserting the first end into the neck portion in one of the pinions, and elastically deforming the timing bar to insert the second end into the neck portion in the other of the pinions thereby coupling the pinions to rotate as one.

In yet another example aspect, the pinions are identical in shape to one another.

In yet another example aspect, the each of the racks includes a first marking indicating a predetermined location along a length of the rack. The pinions include a second marking indicating a predetermined angular position of the pinion such that the predetermined location and the predetermined angular position correspond to a state of assembly.

In yet another example aspect, the first marking and the second marking are shaped to indicate a state of alignment for the predetermined location and the predetermined angular position.

In yet another example aspect, a method of assembling a drawer assembly is provided. The drawer assembly includes a basket portion, a door portion and a screw with a first tapered surface. The basket portion includes two first brackets located at substantially opposite locations. Each of the first brackets provides a first aperture. The door portion includes two second brackets. Each of the second brackets provides a second aperture configured to be aligned with a corresponding first aperture. One of the first aperture and the second aperture includes a second tapered surface configured to substantially match the first tapered surface. The method includes the step of aligning the first aperture and the second aperture by inserting the screw into the first aperture and the second aperture such that the first tapered surface contacts the second tapered surface thereby aligning the door portion to the basket portion.

BRIEF DESCRIPTION OF THE DRAWINGS

These and other aspects are better understood when the following detailed description is read with reference to the accompanying drawings, in which.

DETAILED DESCRIPTION

Figure 1:
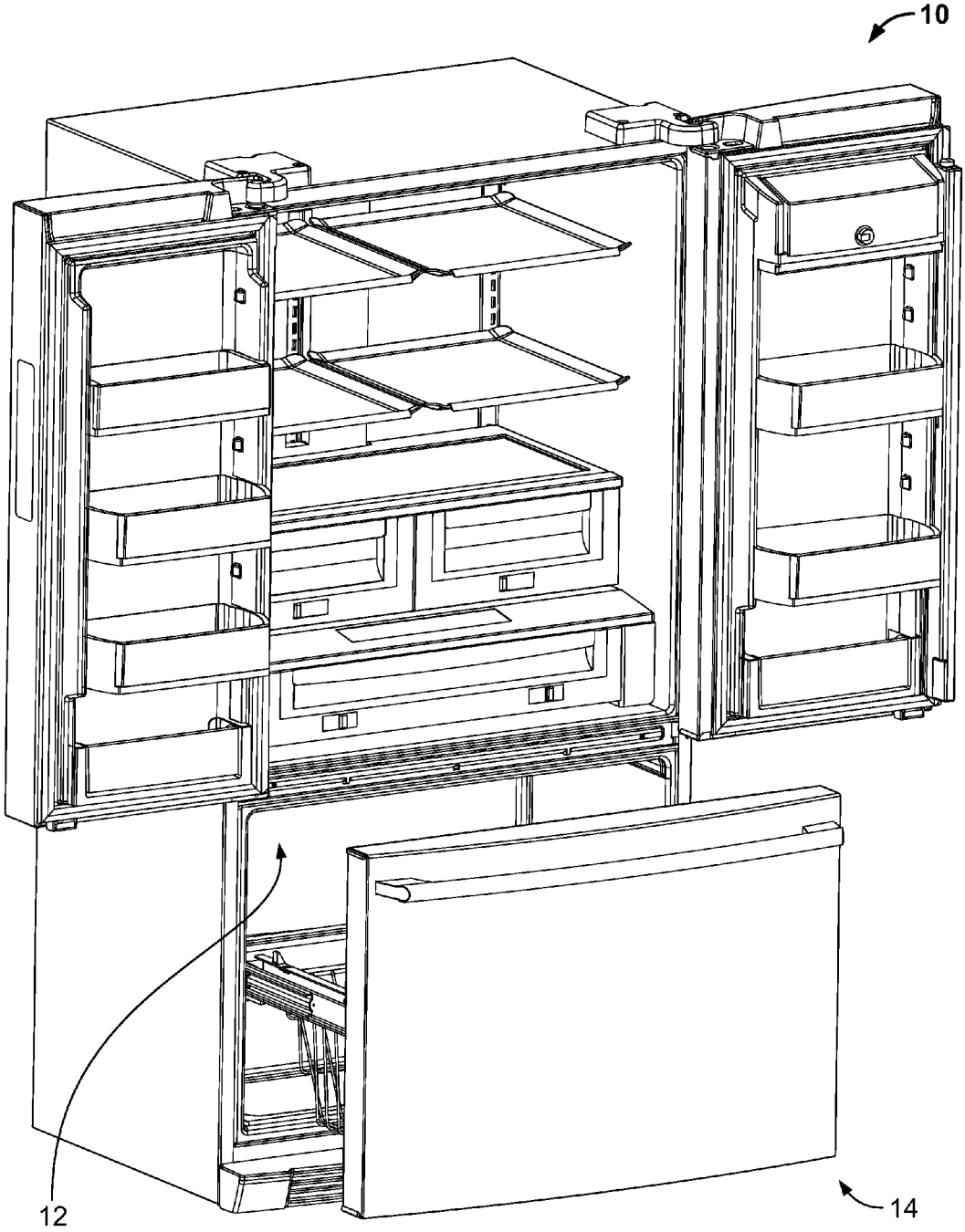
FIG. 1 is an example cabinet structure for implementing the apparatus and methods discussed herein.

Examples will now be described more fully hereinafter with reference to the accompanying drawings in which example embodiments are shown. Whenever possible, the same reference numerals are used throughout the drawings to refer to the same or like parts. However, aspects may be embodied in many different forms and should not be construed as limited to the embodiments set forth herein.

Referring now to FIG. 1, a cabinet for implementing the apparatus described herein is shown. The cabinet 10 shown in FIG. 1 is an appliance and, more specifically, a refrigerator with a fresh-food compartment with French doors and a bottom-mount freezer compartment although other embodiments can be refrigerators with an alternative arrangement of compartments. The cabinet 10 can also be any other cabinet-like structure that provides a storage space or an enclosure 12 and may be characterized as a drawer, a desk, a container, a chest, a safe, a cupboard, a cabinet or the like. The storage space of the cabinet 10 may be provide a particular type of environment for items stored therein and, for example, may be suitable for refrigeration, heating, sanitization, a vacuum, etc.

The enclosure 12 may accommodate a drawer assembly 14 which may have a box-like configuration that is insertable in the enclosure which may have a corresponding shape. The drawer 16 may have a shape other than a box and, for example, may be semi-cylindrical. As shown in FIG. 1, the enclosure 12 of the cabinet 10 may be provided such that a drawer 16 makes up an entire compartment and is accessed directly from the exterior of the cabinet 10. Alternatively, the drawer 16 may make up a part of a compartment and may be accessed indirectly after a door of such a compartment is first opened.

Figure 2:
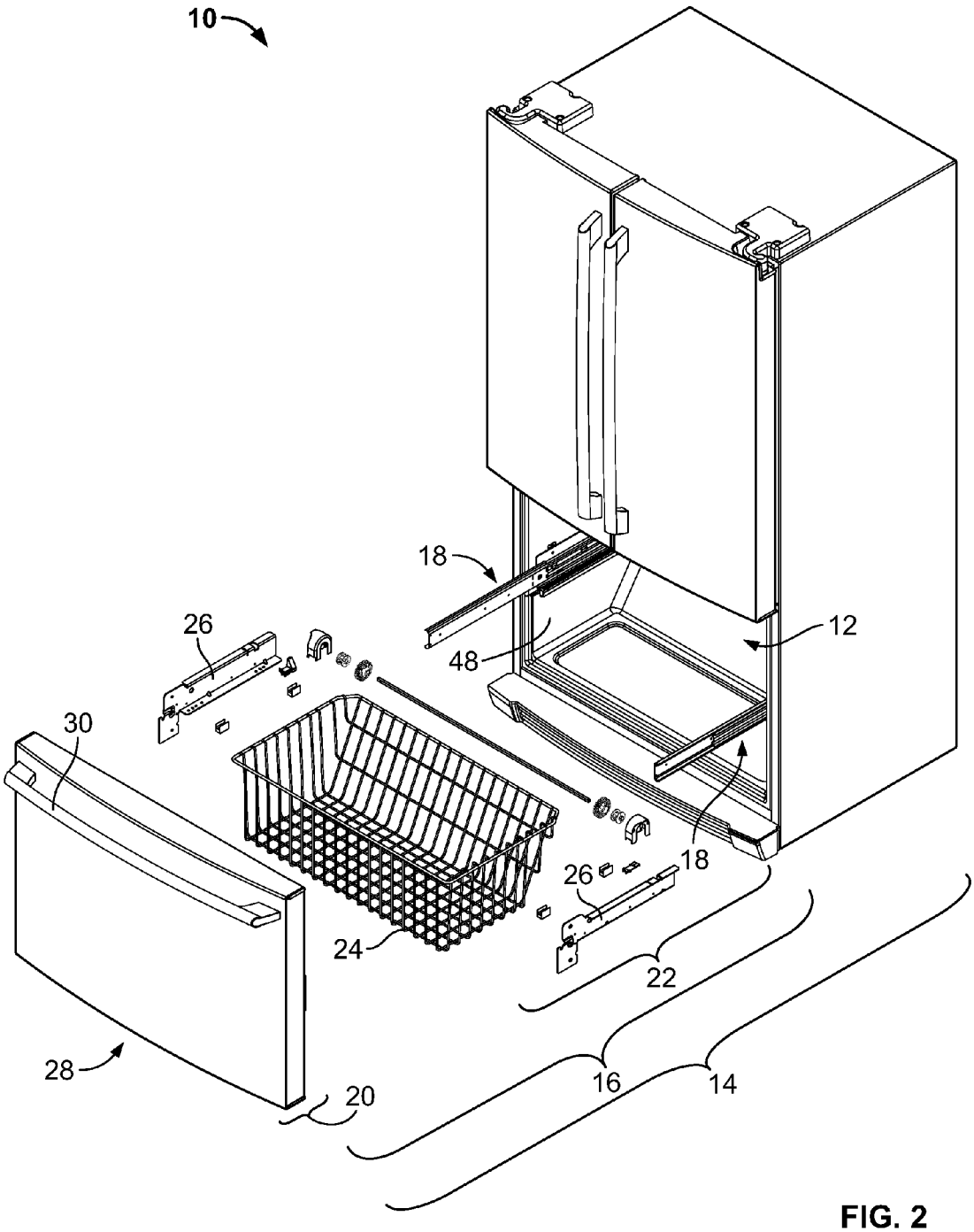
FIG. 2 is an exploded view of an example drawer assembly.
Figure 3:
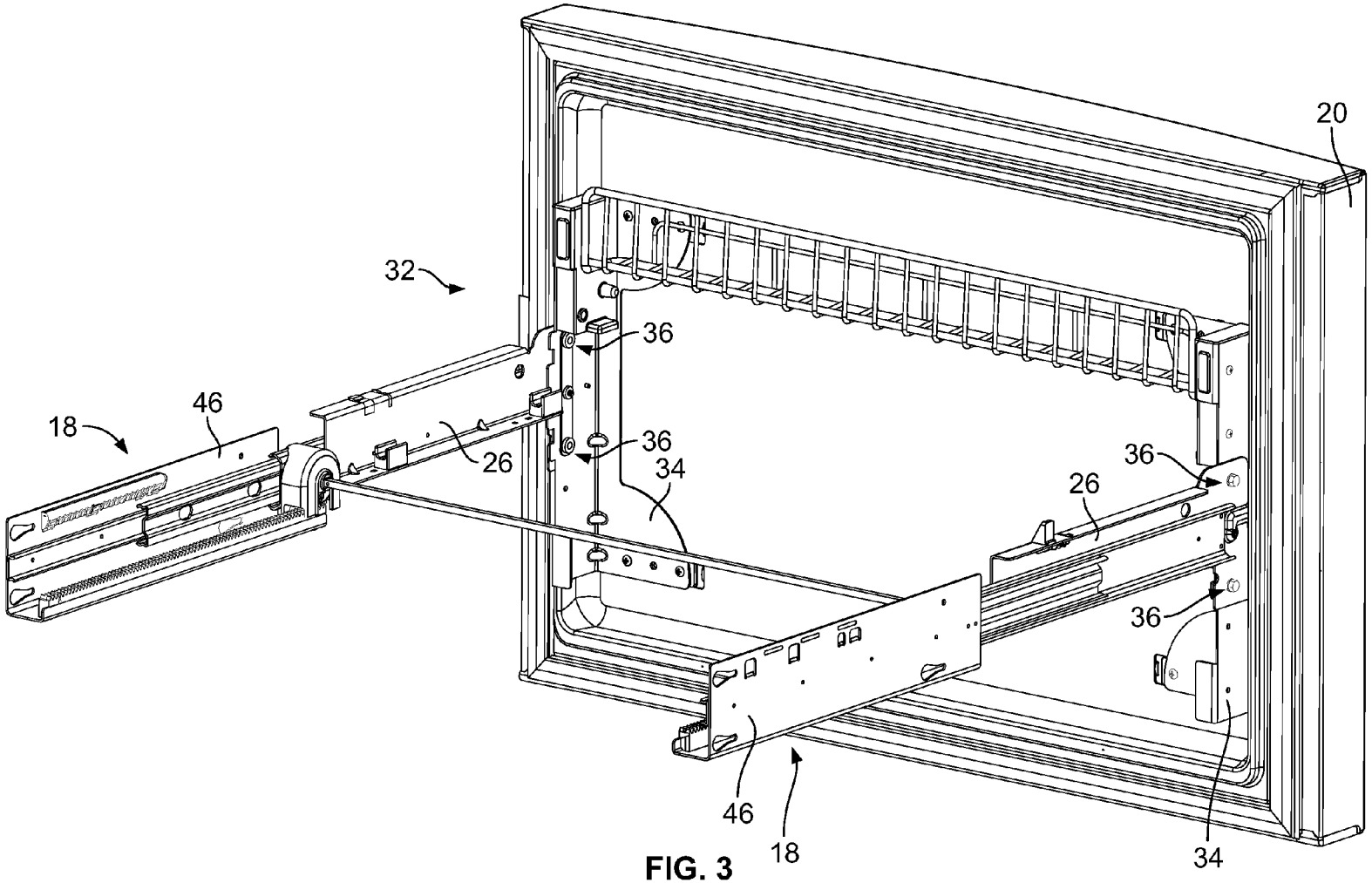
FIG. 3 is a perspective view of an internal side of a door portion of a drawer in an isolated state.

FIGS. 2 and 3 respectively show an exploded view and an assembled view of an example embodiment of the drawer assembly 14. In the present embodiment, the drawer assembly 14 includes a drawer 16 and a pair of motion control mechanisms 18. The drawer 16 may include a door portion 20 and a basket portion 22. Moreover, the basket portion 22 may include a basket 24 and side supports 26.

Figures 4, 4A:
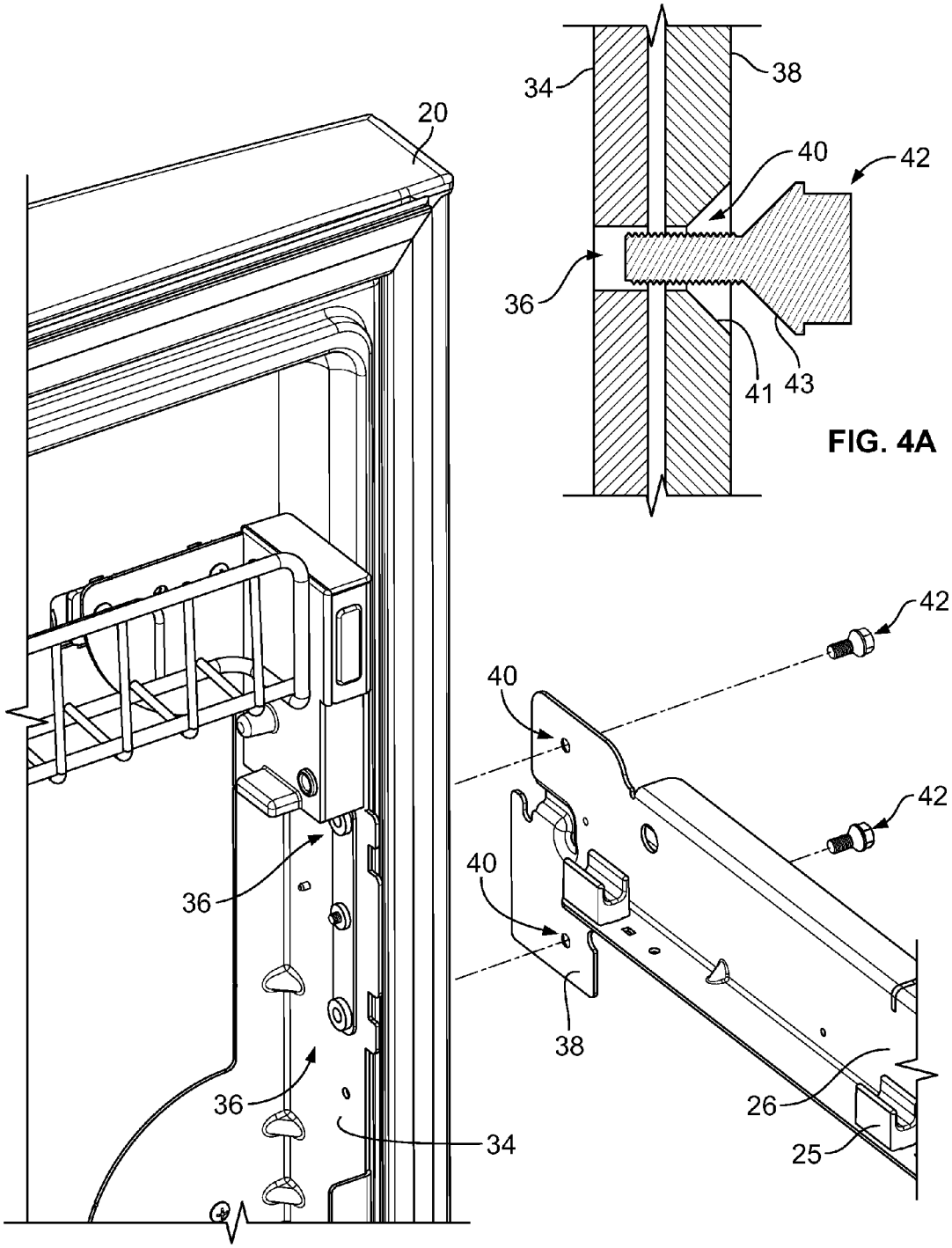
FIG. 4 is a close-up view of a first bracket of the door portion and a second bracket of a side support.
FIG. 4A is a cross-sectional view of the first bracket, the second bracket and a tapered head screw.

As shown in FIG. 2, the door portion 20 of the drawer 16 may include an external side 28 that is configured to conform to other parts of the cabinet 10 in shape and may include a grasping means, such as a handle 30, so that the drawer 16 can be manually pulled out of and pushed into the enclosure 12. As shown in FIGS. 3-4, on an internal side 32 of the door portion 20, a set of first brackets 34 having a set of first apertures 36 may be mounted to the door portion 20 using securing means known in the art. The basket 24 of the basket portion 22 may be flanked by side supports 26 on substantially opposite locations (FIG. 2). The side supports 26 may be plate-like components allowing the basket 24 to be secured therebetween using a variety of means known in the art, such as snap-ins, screws, nuts and bolts, hooks, glue, etc. In the present embodiment, the side supports 26 include a plurality of pedestals 25 (FIG. 4) for receiving wire portions of the basket 24. While the basket 24 may be formed from multiple parts such as interwoven wires, the basket 24 may also be formed in a single piece such as by molding polymeric material. The side supports 26 may also include a set of second brackets 38 (FIG. 3) with a set of second apertures 40 that are configured to be aligned with the first apertures 36 of the first brackets 34. Tapered head screws 42 may be inserted through the first and second apertures 36, 40 to facilitate alignment of the door portion 20 with respect to the basket portion 22. As shown in FIG. 4A, the tapered head screws 42 may include a first tapered surface 43 that is adapted to substantially match a geometry of a second tapered surface 41 of the second brackets 38 that may be provided on the side of the second apertures 40 through which the tapered head screws 42 are inserted. Interaction between the first tapered surface 43 and the second tapered surface 41 helps proper orientation or alignment of a central axis of the screw 42 with respect to the aperture 40 which consequently improves alignment of the first aperture 36 about the second aperture 40.

Figure 8:
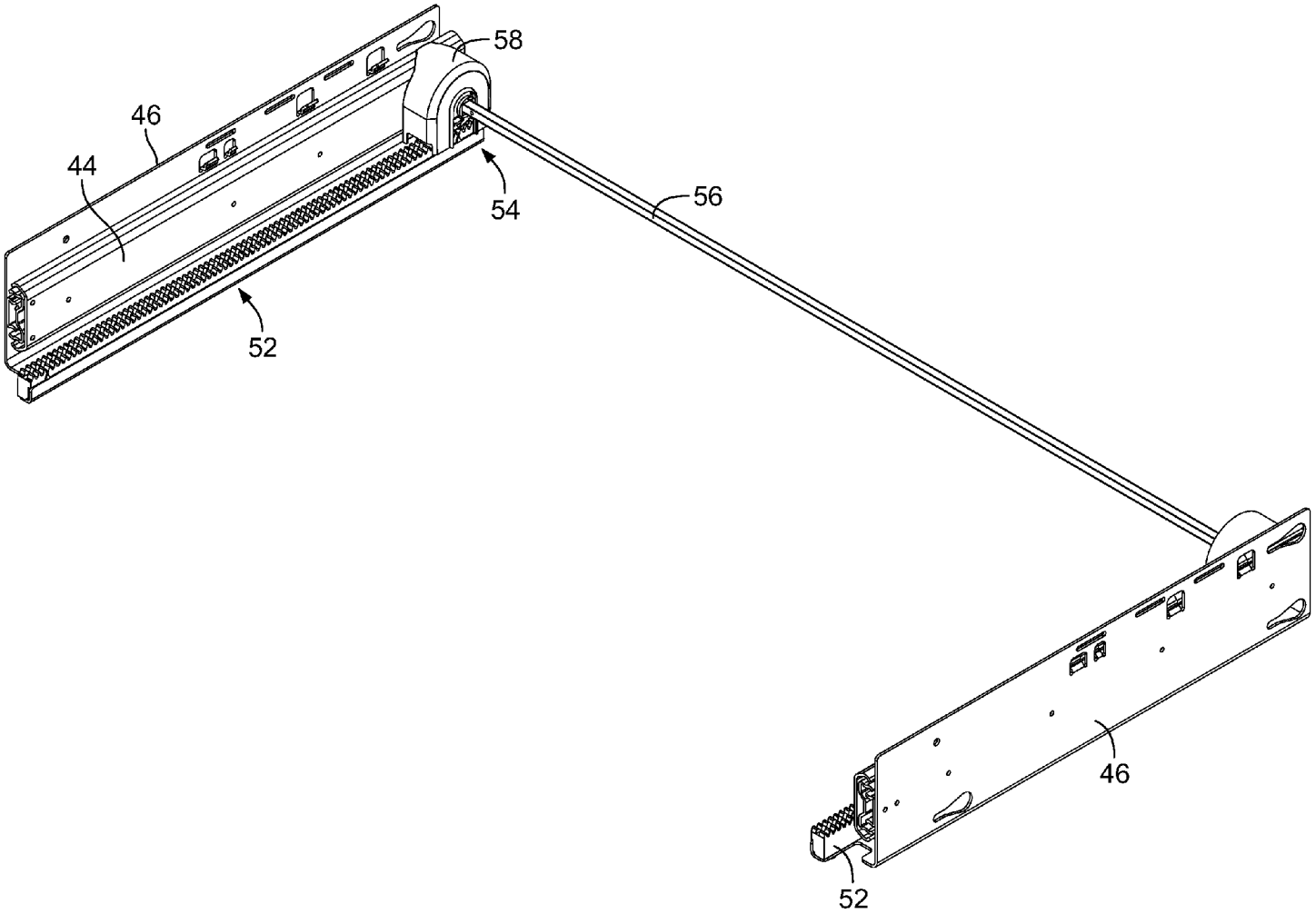
FIG. 8 is a perspective view of the motion control mechanism in a retracted position.
Figure 9:
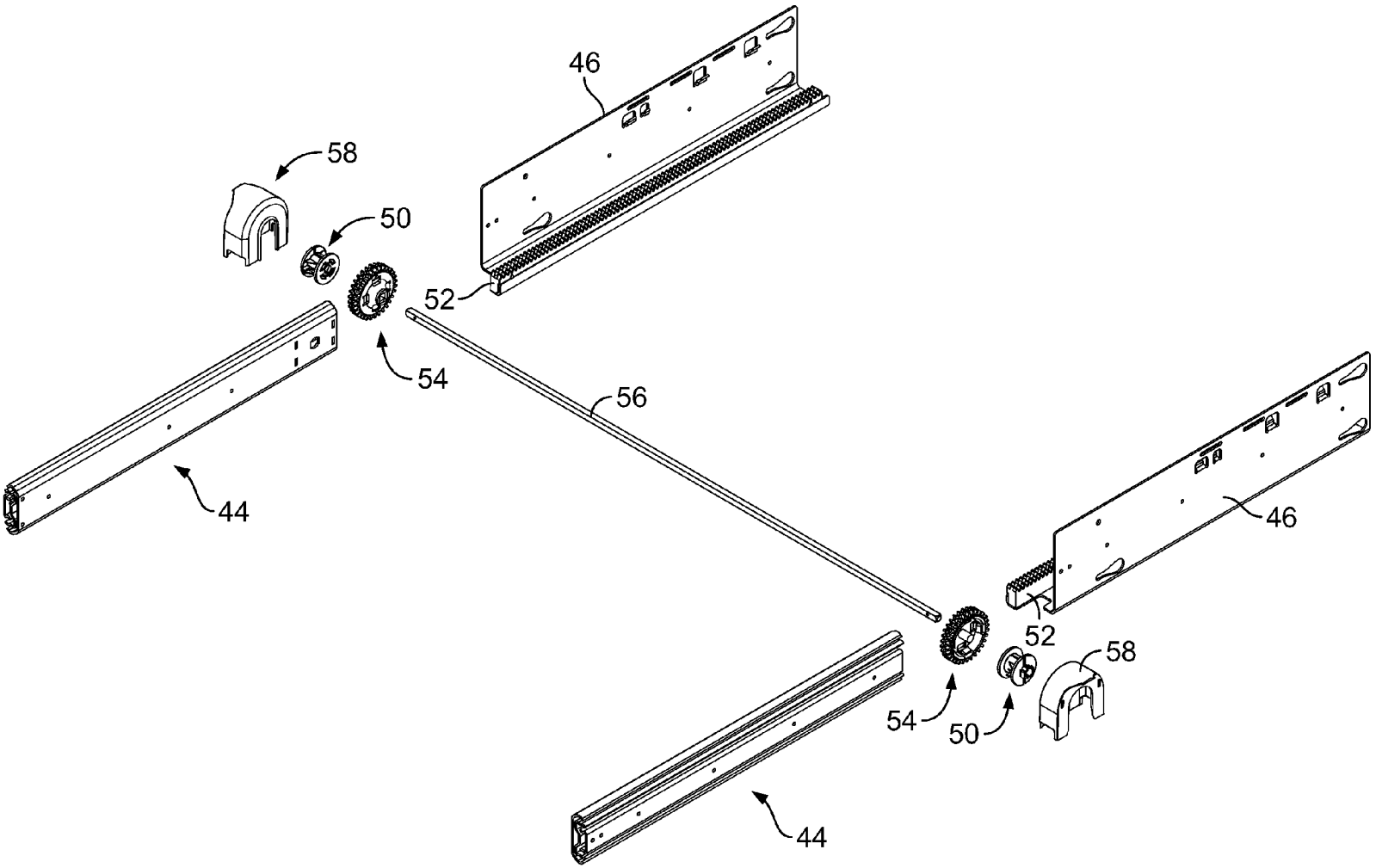
FIG. 9 is an exploded view of the motion control mechanism.

As shown in FIGS. 5-9, the motion control mechanisms 18 are provided laterally of the drawer 16, for example, one on each side. Each motion control mechanism 18 may include a linear motion element 44 in order to allow the drawer 16 to move in and out of the enclosure 12 and a rack-and-pinion structure in order to prevent tilting of the drawer 16 during linear movement. In the present embodiment, the motion control mechanism 18 includes a mounting bracket 46 (FIG. 6) about which the linear motion element 44 and the rack-and-pinion structure may be mounted. The mounting brackets 46 may be mounted on or near two interior surfaces 48 (FIG. 10) which are disposed opposite one another in the enclosure 12. The motion control mechanisms 18 allow the drawer 16 to move between an extended, open state (FIG. 7) and a retracted, closed state (FIG. 8). As shown in FIG. 9, the motion control mechanism 18 may include the mounting bracket 46, the linear motion element 44, a bushing 50 (FIG. 9), a rack 52, a pinion 54, a timing bar 56 and a cover 58.

Figure 10:
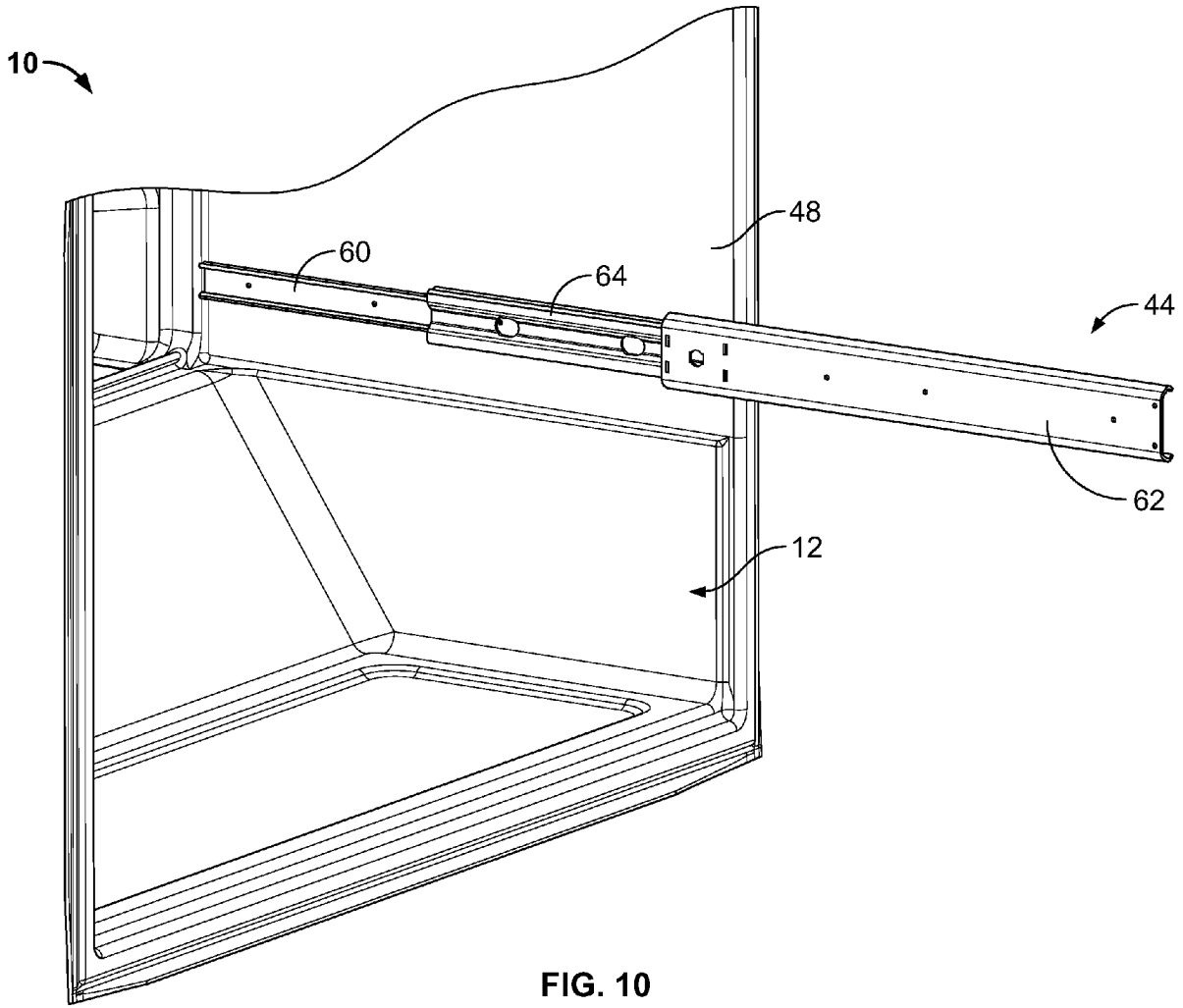
FIG. 10 is a perspective view of a linear motion element in the extended position and mounted inside an enclosure of the cabinet structure.
Figure 11:
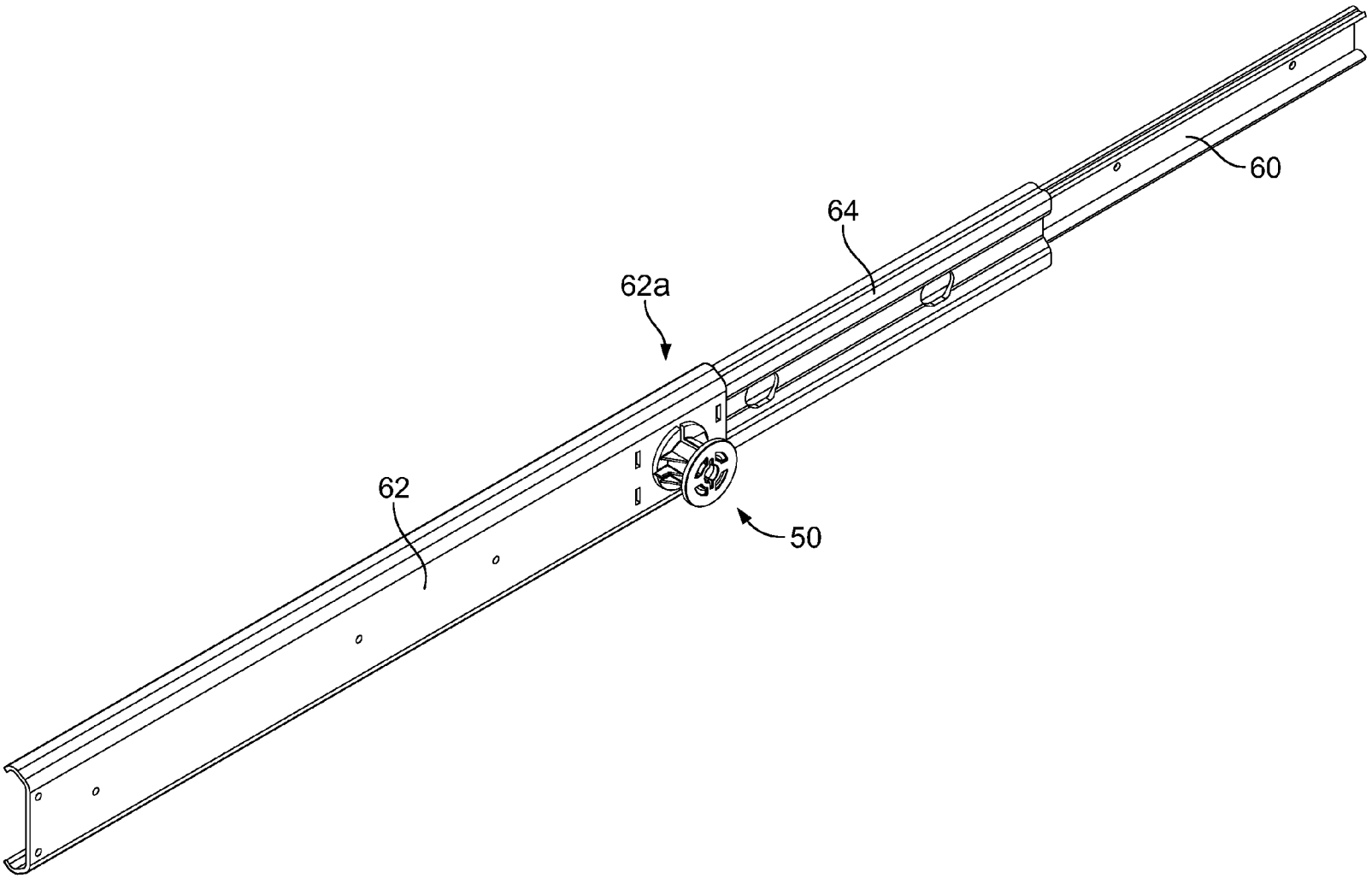
FIG. 11 is a perspective view of the linear motion element.

As shown in FIGS. 10-11, the linear motion element 44 may, for example, be a slide mechanism that may utilize a plurality of elongate members that slide or glide against one another. Linear motion may also be enabled using telescopic members that have varying cross-sections and are housed within one another in a retracted position. The cross-sectional shapes may vary and have a "U" shape, a circular shape, etc. The linear motion may be enabled using plain bearings, such as dovetail slides, ball bearings, roller bearings, or other means known in the art. The linear motion element 44 may utilize alternative structures such as wheels rolling about rails.

Figure 5:
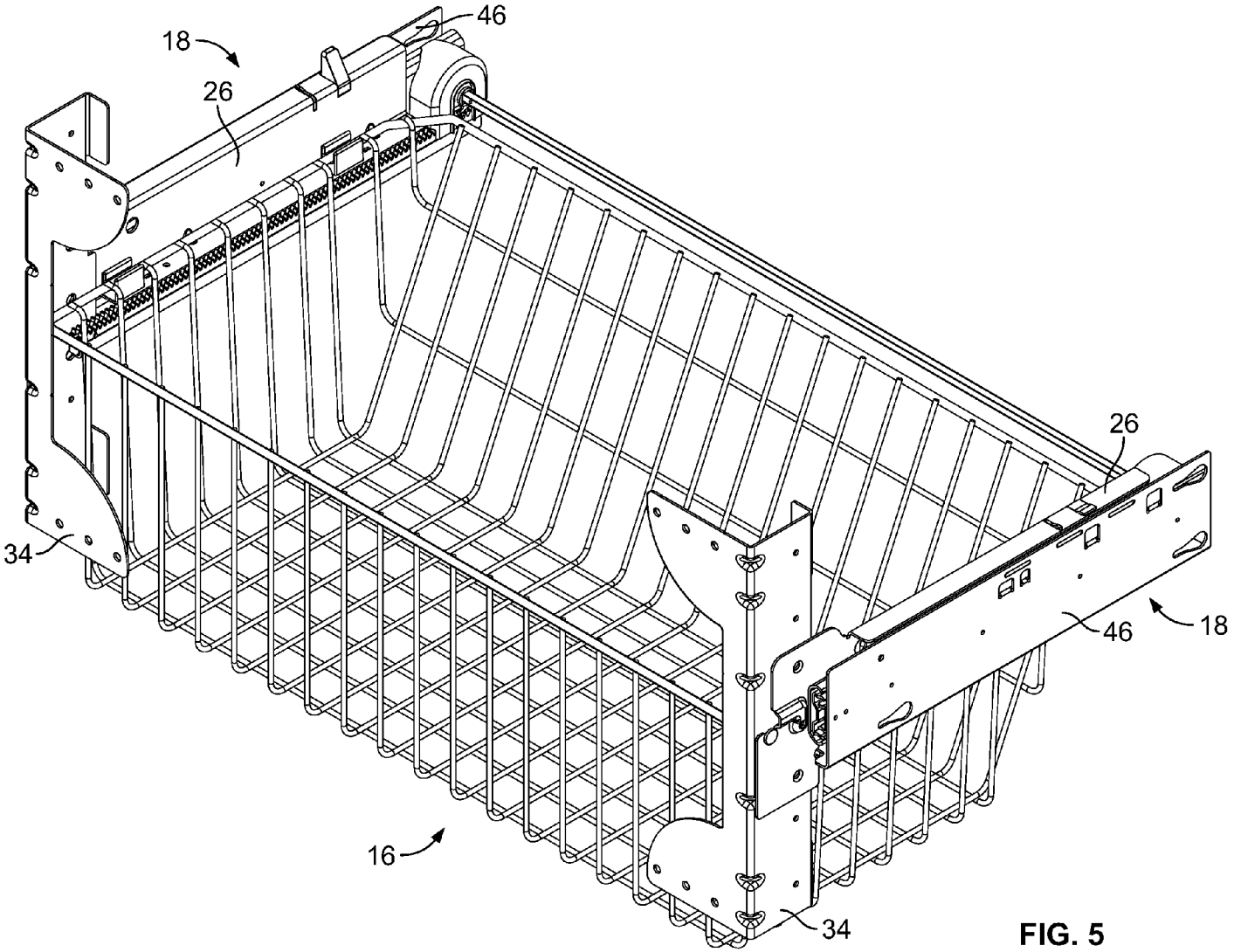
FIG. 5 is a perspective view of a basket portion of the drawer in an isolated state.
Figure 6:
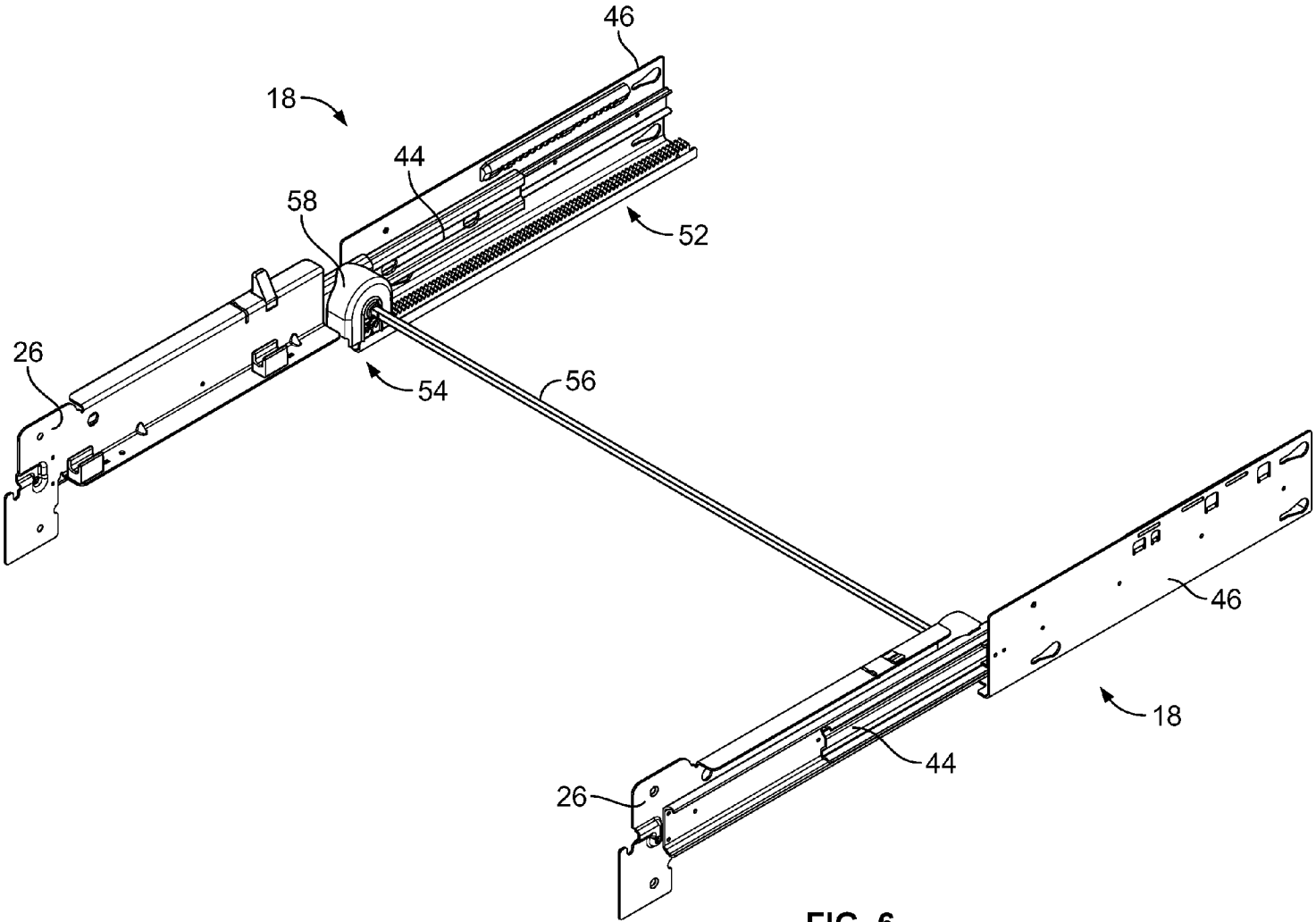
FIG. 6 is a perspective view of a motion control mechanism and the side supports in an extended position.
Figure 7:
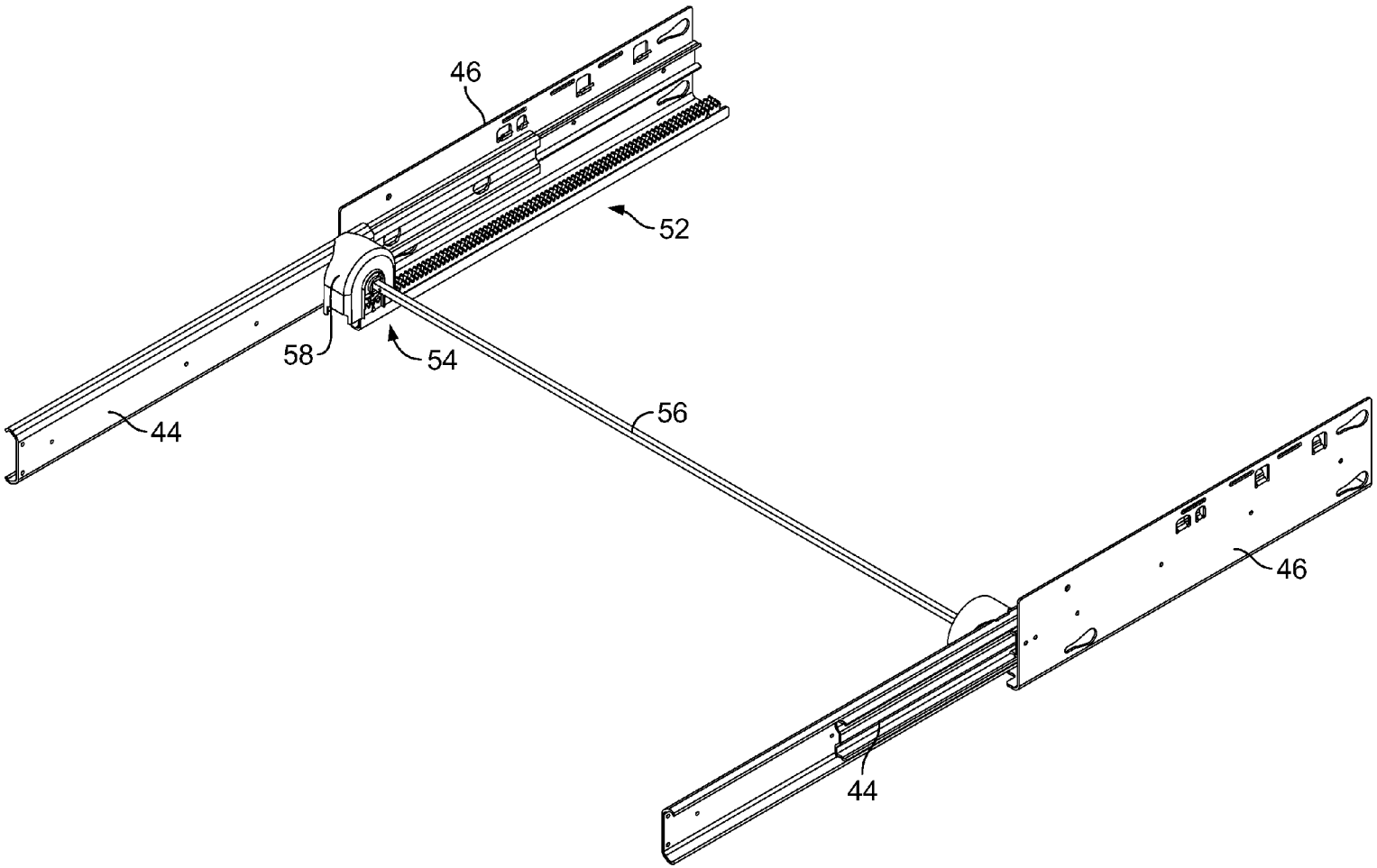
FIG. 7 is a perspective view of the motion control mechanism in an extended position.

As shown in FIG. 11, the elongate members may include a stationary member 60 and a moving member 62 that moves relative to the stationary member 60 to move between the refracted position and the extended position. Alternatively, the elongate members may include one or more intermediate members 64 linking the stationary member 60 to the moving member 62 but the stationary member 60 and the moving member 62 may still correspond to the outermost portions of the linear motion element 44 in the extended position. The elongate members may include stopping means to limit the range of movement of one elongate member with respect to another. The stationary member 60 may be provided with means to secure the stationary member 60 directly or indirectly to the interior surface 48 while the moving member 62 may be provided with means to secure the moving member directly or indirectly to the drawer 16, for example, by engaging the side supports 26. Such means may include holes for screws, hooks, glue, etc. In this embodiment, the stationary members 60 are secured to the mounting bracket 46 (FIG. 2) while the moving members 62 are secured to the side supports 26 (FIG. 5-6).

Figure 13A:
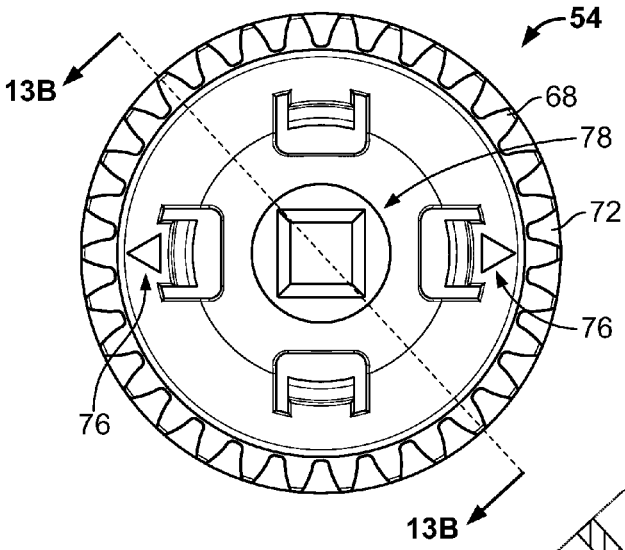
FIG. 13A is a front view of a pinion showing an example second marking.
Figure 13B:
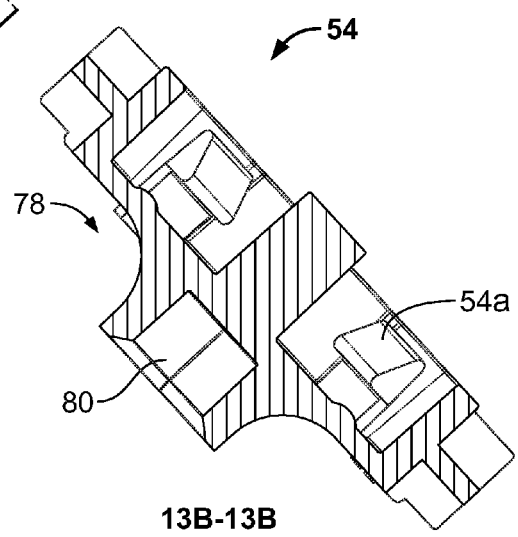
FIG. 13B is a cross-sectional view of the pinion.

As shown in FIGS. 11 and 15, the bushing 50 or adapter may be rotatably coupled about a part of the moving member 62. In the present embodiment, the bushing 50 is mounted on an inner end 62*a* of the moving member 62 so as to undergo linear motion along with the drawer 16 and move between the refracted position and the extended position. The bushing 50 may include a male portion 50*a* of a snap-in connection by which the bushing 50 can become coupled to the moving member 62 in a rotatable fashion. Moreover, the bushing may include an external section 50*b* with female portions 50*c* which may be engaged by male portions 54*a* of the pinion 54 as shown in FIGS. 13B and 15. Alternatively, the male and female portions may be provided differently on the bushing 50 and the pinion 54 and it may be possible to rotatably couple to the pinion 54 to the bushing 50 while coupling the bushing 50 non-rotatably about the moving member 62.

Figure 12:
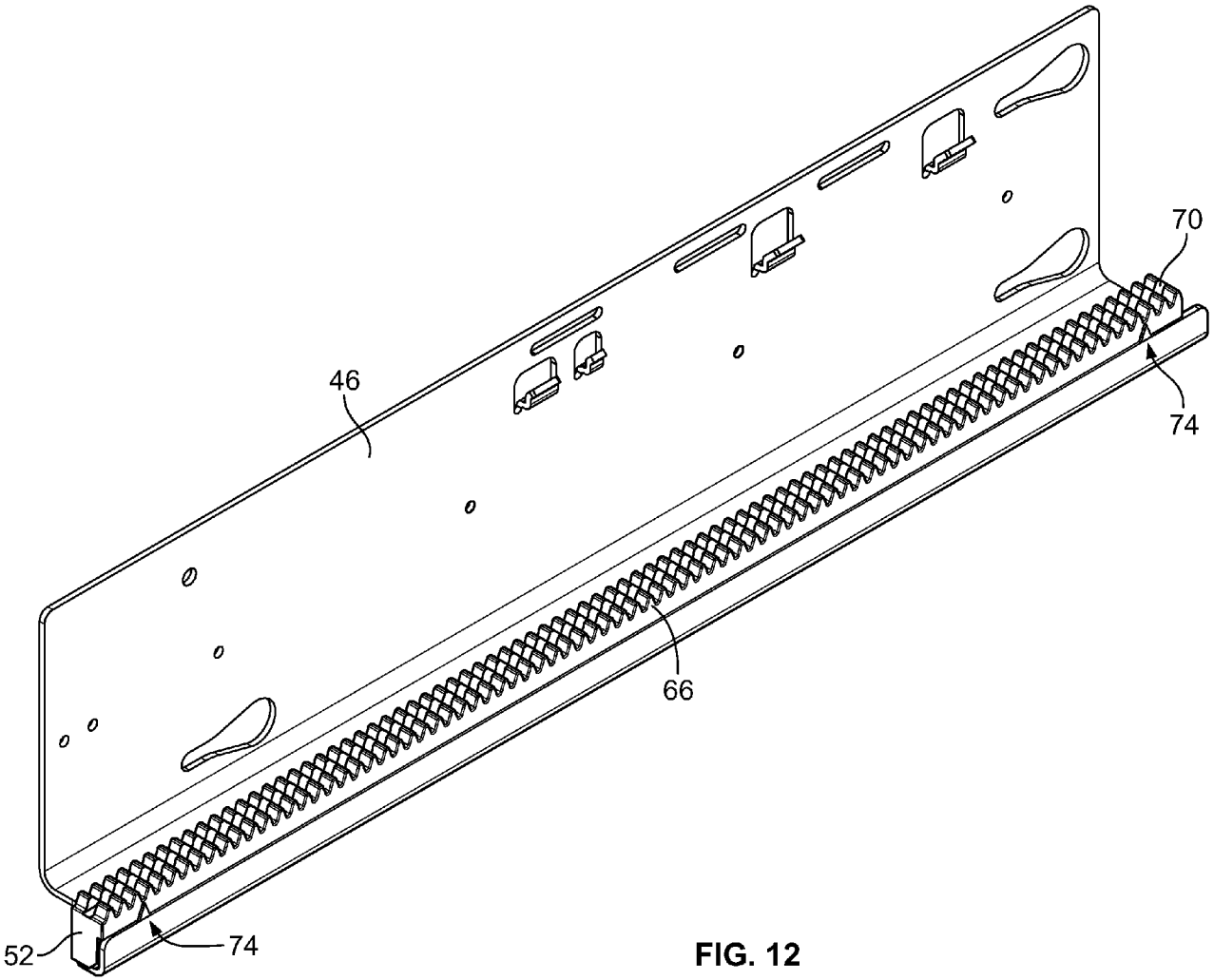
FIG. 12 is a perspective view of a mounting bracket and a rack with an example first marking.

As shown in FIG. 12, the rack 52 may be provided on the mounting bracket 46 so as to be adjacent the linear motion elements 44 and the pinion 54 such that, as the drawer 16 and, consequently the moving member 62, move in and out of the enclosure 12, the pinion 54 is allowed to rotate along the rack 52. The rack is provided longitudinally with a set of first teeth 66 which is adapted to mesh with a set of second teeth 68 that are circumferentially provided on the pinion 54. The cover 58 (FIG. 9) may be secured on the moving member 62 so as to protect the rotation of pinion 54 from obstruction caused by items in the enclosure 12.

Figure 13C:
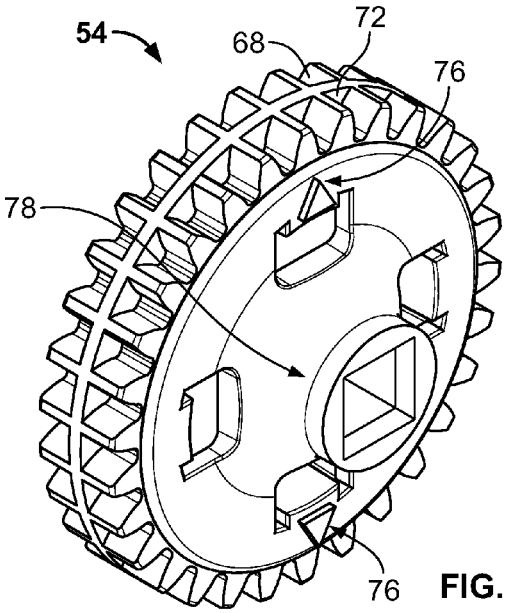
FIG. 13C is a front perspective view of the pinion showing a wall extending along a second set of teeth.
Figure 14B:
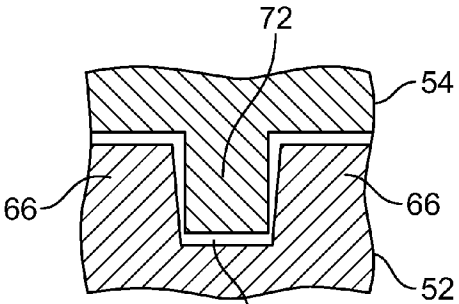
FIG. 14B is a cross-sectional view of a wall and a groove when a first set of teeth are meshed with the second set of teeth.
Figure 14A:
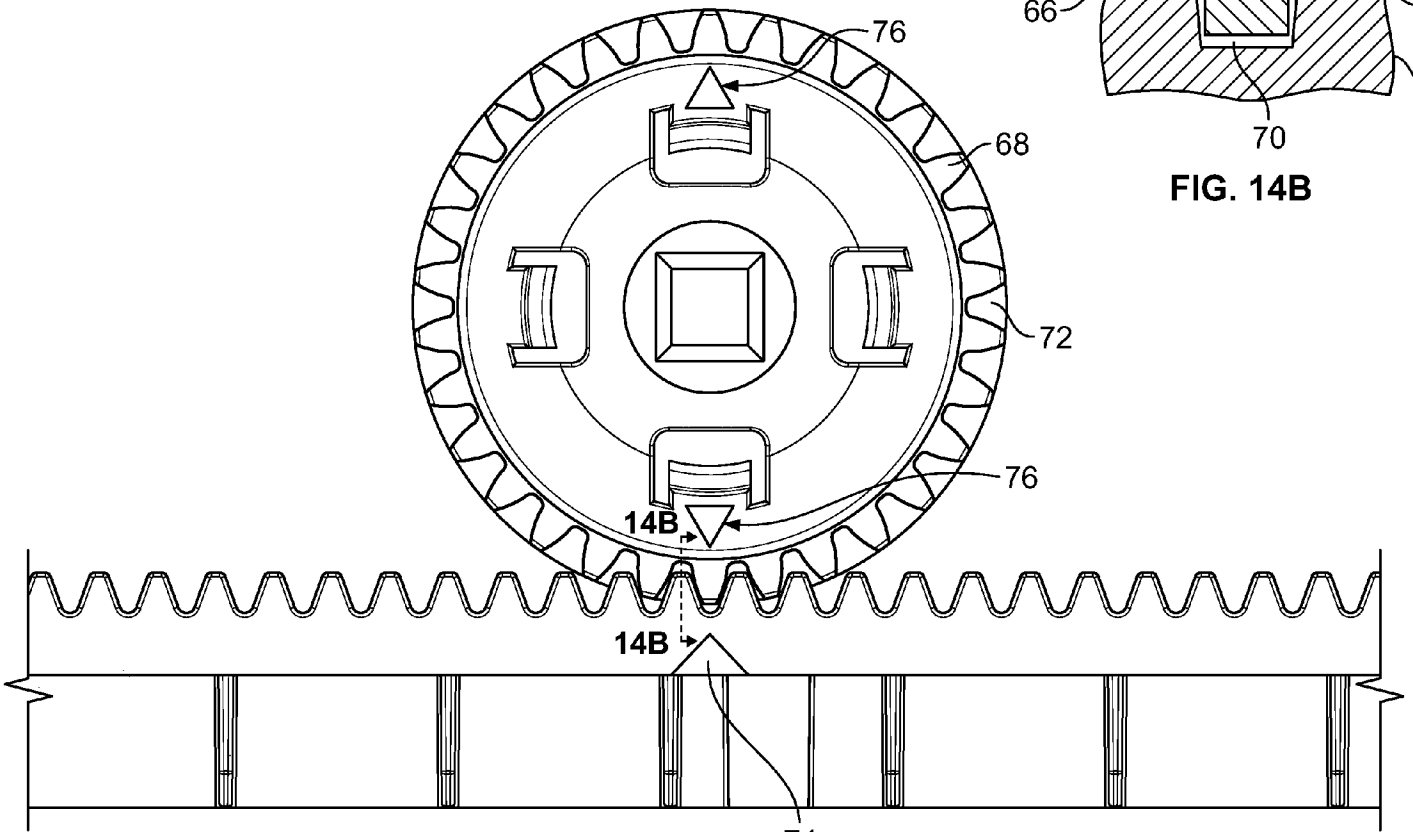
FIG. 14A is a view of the pinion and the rack in an assembled state showing the first marking and the second marking in alignment.
Figure 15C:
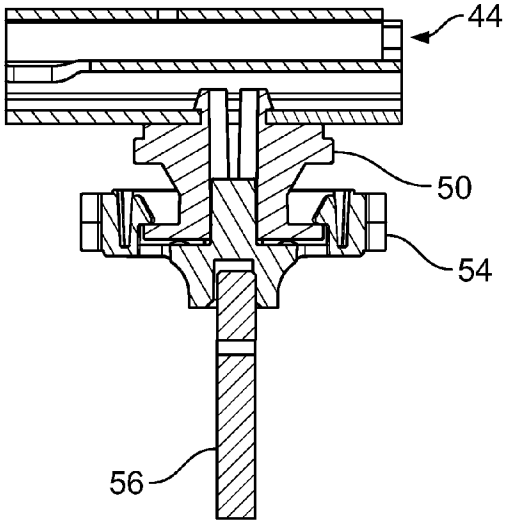
FIG. 15C is a cross-sectional view of the linear motion element, the bushing, the pinion and a timing bar.
Figure 15A:
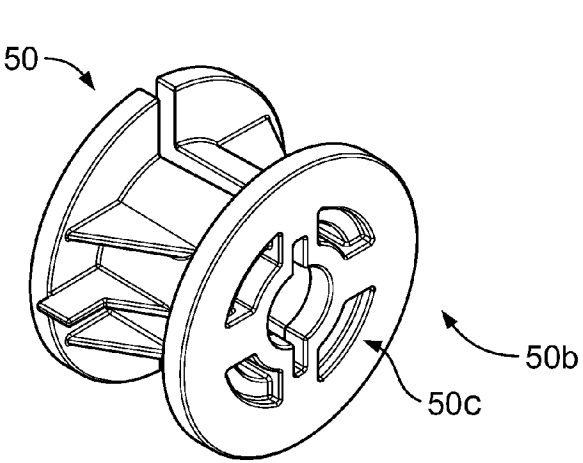
FIG. 15A shows a front perspective view and a rear perspective view of a bushing.
Figure 15A:
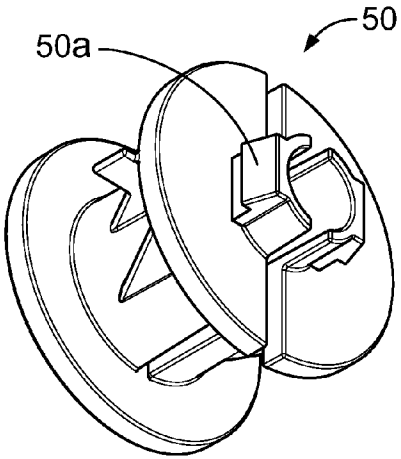
Figure 15B:
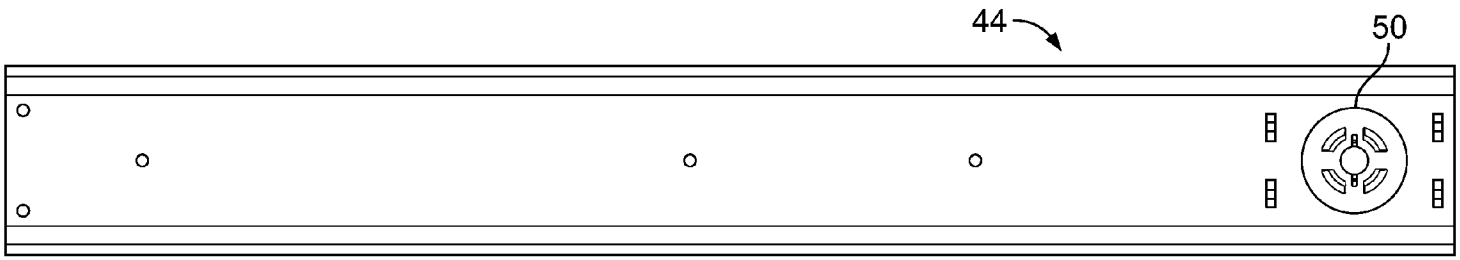
FIG. 15B is a front view of the linear motion element with the bushing mounted thereon.

The rack 52 and the pinion 54 may include additional features in order to further stabilize meshing between the first teeth 66 and the second teeth 68. For example, as shown in FIGS. 12, 13A, 13C and 14B, the rack 52 may include a groove 70 that extends along the first teeth 66 while the pinion 54 may include a wall 72 that extends circumferentially across the second teeth 68. Although the wall 72 extends through the center of the second teeth 68 while the groove 70 extends through the center of the first teeth 66 in this embodiment, the location of the wall 72 and the corresponding location of the groove 70 may be moved to locations other than the center. The wall 72 is configured to mate with and be guided by the groove 70 as the pinion 54 rotates and moves along the rack 52. The height of the wall 72 may be configured to be similar to or shorter than the depth of the groove 70 as shown in FIG. 14B. Moreover, the wall 72 may be similar in height to the second teeth 68. The dimensions of the groove 70 and the wall 72 may be adjusted such that there is little play between the groove 70 and the wall 72 and the meshing between the first teeth 66 and the second teeth 68 is ensured through the length of the rack 52. Similarity between the width of the groove 70 and the width of the wall 72 and/or similarity between the depth of the groove 70 and the height of the wall 72 may also contribute in this respect. The similarity may be such that the width of the groove 70 and the width of the wall 72 and/or the depth of the groove 70 and the height of the wall 72 are substantially matching. While this embodiment shows the groove 70 provided on the rack 52 and the wall 72 provided on the pinion 54, the groove 70 may be provided on the pinion 54 and the wall 72 may be provided on the rack 52 instead.

In order to ensure that the pinion 54 is mounted at identical locations on each rack 52 on both sides of the drawer 16, the rack 52 may be provided with a first marking 74 and the pinion 54 may be provided with a second marking 76 as shown in FIGS. 12, 13A, 13C and 14. The first marking 74 may indicate a predetermined location along the length of the rack 52 at which the pinion 54 should engage the rack 52 when these two components are assembled together and the second marking 76 may indicate a predetermined angular position of the pinion 54 for such an assembly. The markings 74, 76 may be configured on portions of the pinion 54 and the rack 52 that are visible to allow an assembly line worker to properly align the parts and, for example, may be provided on a side surface of the pinion 54 and a side surface of the rack 52 as shown in FIG. 14A. The markings 74, 76 can be embodied through engraving, printing, or other means known in the art and may have shapes that can indicate a state of alignment such as an arrow, a triangle, a line or the like.

The pinions 54 on each interior surface 48 of the enclosure 12 are coupled to one another through the timing bar 56 in order to ensure that the pinions 54 rotate as one undergoing the same angular rotation at all times. One manner of accomplishing this is by providing on each pinion 54 a neck portion 78 (FIGS. 13A-13C) with a cavity 80 in which an end of the timing bar 56 can be inserted. The neck portion 78 of the pinion 54 for each side of the drawer 16 may be identical in shape and length. The cross-section of the end of the timing bar 56 and the cross-section of the cavity 80 are shaped such that the timing bar 56 is not allowed to rotate about the pinion 54. For example, the cross-sections may have polygonal shapes, such as a rectangle, as shown in FIGS. 13A, 13C and 14. The timing bar 56 may be made of elastically deformable material such that the timing bar 56 may be assembled to the drawer assembly 14 after the pinions 54 are mounted on the motion control mechanisms 18. Specifically, the degree of deformation may be such that, when one end of the timing bar 56 is inserted in one of the neck portions 78, the timing bar 56 can undergo sufficient bending or elastic deformation to allow the other end to be inserted in the opposite neck portion 78. Such deformation and insertion of the timing bar 56 may be facilitated by shortening the length of the cavity in the neck portions 78.

It will be apparent to those skilled in the art that various modifications and variations can be made without departing from the spirit and scope of the claimed invention.

What is claimed is:

1. A drawer assembly for an enclosure including a first interior surface and a second interior surface, the interior surfaces being opposite one another, the drawer assembly including:

a first rack and a second rack mounted respectively near the first interior surface and the second interior surface, each of the two racks including a first marking indicating a predetermined location along a length of the rack; and a drawer configured to be movable in and out of the enclosure and including a first face near the first interior surface and a second face near the second interior surface, the drawer including a first pinion and a second pinion rotatably coupled near the first face and the second face respectively, the pinions including circumferential second teeth, the first pinion and the second pinion configured to mesh with the first rack and the second rack respectively, each of the pinions including a second marking indicating a predetermined angular position of the pinion such that the predetermined location and the predetermined angular position correspond to a state of assembly.

2. The drawer assembly of claim 1, further including a first linear motion element and a second linear motion element mounted respectively near the first interior surface and the second interior surface, each of the linear motion elements configured to enable movement of the drawer in and out of the enclosure.

3. The drawer assembly of claim 1, wherein the first marking is shown on a side of the one of the racks and the second marking is shown on a side of the one of the pinions.

4. The drawer assembly of claim 1, wherein the first marking and the second marking are shaped to indicate a state of alignment for the predetermined location and the predetermined angular position.

5. The drawer assembly of claim 1, wherein the first marking and the second marking are triangular in shape.

6. The drawer assembly of claim 1, further including a timing bar configured to couple the first and second pinions so that the pinions rotate as one.

7. A method of assembling a drawer assembly for an enclosure including a first interior surface and a second interior surface, the drawer assembly including a drawer, a first rack, a second rack, a first linear motion element, a second linear motion element and a timing bar, the drawer configured to be insertable in the enclosure, the first rack and the second rack mounted respectively near the first interior surface and the second interior surface, the first linear motion element and the second linear motion element mounted respectively near the first interior surface and the second interior surface, the linear motion elements configured to enable movement of the drawer in and out of the enclosure, a pinion coupled to each of the linear motion elements and configured to rotate along a corresponding rack as the drawer is moved in and out of the enclosure, each of the pinions including a neck portion, the timing bar including a first end and a second end, the method including the steps of:

inserting the first end into the neck portion in one of the pinions; and elastically deforming the timing bar to insert the second end into the neck portion in the other of the pinions thereby coupling the pinions to rotate as one, wherein each of the racks includes a first marking indicating a predetermined location along a length of the rack, and each of the pinions includes a second marking indicating a predetermined angular position of the pinion such that the predetermined location and the predetermined angular position correspond to a state of assembly.

8. The method of claim 7, wherein the pinions are identical in shape to one another.

9. The method of claim 7, wherein the first marking and the second marking are shaped to indicate a state of alignment for the predetermined location and the predetermined angular position.

* * * * *